US010497294B2

(12) United States Patent
Hong

(10) Patent No.: US 10,497,294 B2
(45) Date of Patent: Dec. 3, 2019

(54) ARRAY TEST CIRCUIT

(71) Applicant: Wuhan China Star Optoelectronics Technology Co., Ltd., Wuhan, Hubei (CN)

(72) Inventor: Guanghui Hong, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 170 days.

(21) Appl. No.: 15/571,004

(22) PCT Filed: Oct. 19, 2017

(86) PCT No.: PCT/CN2017/106869

§ 371 (c)(1),
(2) Date: Oct. 31, 2017

(87) PCT Pub. No.: WO2019/019430

PCT Pub. Date: Jan. 31, 2019

(65) Prior Publication Data

US 2019/0027073 A1 Jan. 24, 2019

(30) Foreign Application Priority Data

Jul. 24, 2017 (CN) ..... 2017 1 0608552

(51) Int. Cl.
*G09G 3/00* (2006.01)

(52) U.S. Cl.
CPC ..... *G09G 3/006* (2013.01); *G09G 2310/0297* (2013.01)

(58) Field of Classification Search
CPC ..... G06F 1/00; G06F 2101/00; H01L 21/00; H01L 2221/00; H04N 1/00;
(Continued)

(56) References Cited

U.S. PATENT DOCUMENTS

2010/0013791 A1* 1/2010 Haga ..... G06F 3/0412 345/174
2011/0050969 A1* 3/2011 Nishihara ..... G01J 1/44 348/296

(Continued)

FOREIGN PATENT DOCUMENTS

CN 106057111 A 10/2016

*Primary Examiner* — Huy Q Phan
*Assistant Examiner* — Temilade S Rhodes-Vivour
(74) *Attorney, Agent, or Firm* — Hemisphere Law, PLLC; Zhigang Ma

(57) ABSTRACT

An array test circuit is provided. The circuit includes: at least one first demultiplexer module, an enable signal input point, a plurality of measurement and control signal input points, a plurality of data lines, a plurality of enabling switches, a plurality of anti-floating switches, and an inverter. A control terminal of each anti-floating switch is electrically connecting to an inverted enable signal, an input terminal is accessed to an OFF signal of the measurement and control switch, an output terminal is electrically connected to a corresponding measurement and control signal input point. The anti-floating switch can be turned on and input the OFF signal to the measurement and control signal input point when the liquid crystal panel is displayed, it can ensure the demultiplexing switches are kept in OFF state, preventing the switches in floating state and improving the working stability of the liquid crystal display panel.

12 Claims, 4 Drawing Sheets

(58) Field of Classification Search
CPC .. H04N 2010/00; G09G 1/00; G09G 2230/00; H04L 1/00; H04L 2201/00
See application file for complete search history.

(56) References Cited

U.S. PATENT DOCUMENTS

2013/0063404 A1* 3/2013 Jamshidi Roudbari ..... G06F 3/044 345/204
2015/0255139 A1* 9/2015 Atsumi ..... H01L 29/7869 257/43
2016/0378597 A1* 12/2016 Chung ..... G11C 29/52 714/764
2017/0186371 A1* 6/2017 Takahashi ..... G06F 3/0416

* cited by examiner

ARRAY TEST CIRCUIT

RELATED APPLICATIONS

The present application is a National Phase of International Application Number PCT/CN2017/106869, filed Oct. 19, 2017, and claims the priority of China Application No. 201710608552.4, filed Jul. 24, 2017.

FIELD OF THE DISCLOSURE

The present disclosure relates to the field of display technology, and more particularly to an array test circuit.

BACKGROUND

With the development of display technology, liquid crystal display (LCD) and other flat panel display devices with advantages of high quality, low power consumption, thin body and broad application are widely used in mobile phones, television, personal digital assistant, digital cameras, notebook, desktop and other consumer electronic products, becoming a mainstream in the display device.

In general, a liquid crystal display panel is composed of a color filter substrate (CF), a thin film transistor substrate (TFT), a liquid crystal (LC) and a sealant sandwiched between the color filter substrate and a thin film transistor substrate. The molding process of the liquid crystal display panel includes: front-end array process (thin film, photolithography, etching and stripping), middle-end cell process (TFT substrate and CF substrate bonding), and back-end assembling process (driving IC and printed circuit board lamination). Wherein, the front-end array process is mainly forming the TFT substrate to control the movement of liquid crystal molecules; the middle-end cell process is mainly adding liquid crystal between the TFT substrate and the CF substrate; and the back-end process is mainly laminating the driving IC and integrating to the printed circuit board, so as to rotate the liquid crystal molecules to display images.

Array test circuit is used for testing electrical situation on array substrate during the array process of the liquid crystal display panel, it plays a very important role for improving product yield. As shown in FIGS. 1 and 2, the array test circuit is typically located in the upper part of the panel display area, comprising: a plurality of driving units, each driving units comprising: a plurality of array test pads 100, a demultiplexer circuit (DEMUX) 200 that electrically connected to the plurality of array test pads 100, and a test-enable circuit 300. Wherein the demultiplexer circuit 200 includes: one first demultiplexer module 201 and four second demultiplexer module 202; the first demultiplexer module 201 comprises four first thin film transistors (T1), each second demultiplexer modules 202 comprises six second thin film transistors (T2), the test-enable circuit 300 includes twenty-four third thin film transistors (T3).

The gates of the four first thin film transistors (T1) are electrically connected to a first, a second, a third and a fourth control signals (ATC1~ATC4), respectively; the sources of the four first thin film transistors (T1) are all accessed to the data signal; and the drains of the four first thin film transistors (T1) are electrically connected to a corresponding second demultiplexer module 202, respectively.

The gates of the six second thin film transistor (T2) are electrically connected to a fifth, a sixth, a seventh, an eighth, a ninth, and a tenth control signals (ATC5~ATC10); the sources of the six second thin film transistors (T2) are electrically connected to the drains of the first thin film transistor (T1) corresponding to the second demultiplexer module 202 thereof, the drains of the six second thin film transistors (T2) are electrically connected to the test-enable circuit 300.

The gates of the twenty-four third thin film transistors (T3) are all accessed to the enable signal (ATEN), the sources of the twenty-fourth third thin film transistor (T3) are electrically connected to the drains of a second thin film transistor (T2), respectively, and the drains of the twenty-four third thin film transistor (T3) are electrically connected to one data line, respectively.

As shown in FIG. 2, the first to the tenth control signals (ATC1~ATC10), the test-enable signal (ATEN), and the data signal are all input to the corresponding thin film transistors via corresponding array test pads 100 when the array is tested. However, after the test is completed, in a normal operation state of the panel, the array test pads are no longer having signal input, the circuit does not work, the first to the tenth control signals (ATC1~ATC10) are in the floating state, causing each thin film transistor of the demultiplexer 100 also in a floating state, resulting in the panel in an unknown state, causing uncertainty and affecting the stability of the display panel.

SUMMARY

One object of the present disclosure is to provide an array test circuit, which is capable of ensuring switches of the demultiplexer being kept in an OFF state when displaying liquid crystal display panel, and preventing the switches of the demultiplexer being kept in a floating state, for improving the stability of the liquid crystal display panel.

In order to achieve the above object, the present disclosure provides an array test circuit, comprising: at least one first demultiplexer module, an enable signal input point, a plurality of measurement and control signal input points, a plurality of data lines, a plurality of enabling switches, a plurality of anti-floating switches, and an inverter.

Each first measurement and control switch is corresponding to one enabling switch, a control terminal of each first measurement and control switch is electrically connecting to one measurement and control signal input point, an input terminal of each first measurement and control switch is accessing to a data signal, and an output terminal of each first measurement and control switch is electrically connecting to an input terminal of corresponding enabling switch.

Each enabling switch is corresponding to one data line, a control terminal of each enabling switch is electrically connecting to the enable signal input point, and an output terminal of each enabling switch is electrically connecting to one corresponding data line.

Each anti-floating switch is corresponding to one measurement and control input point, a control terminal of each anti-floating switch is electrically connecting to an output terminal of the inverter, an input terminal of each anti-floating switch is accessing to an OFF signal of the measurement and control switch, and an output terminal of each anti-floating switch is electrically connecting to one corresponding measurement and control signal input point.

The enable signal input point is used to receive a high potential enable signal when the array substrate is tested, so that the enabling switch is turned on and the anti-floating switch is turned off. Also, it is to receive a low potential enable signal when the liquid crystal display panel is normally displayed, so that the enabling switch is turned off and the anti-floating switch is turned on.

The measurement and control signal input point is used to receive a measurement and control signal when the array substrate is tested, so that the first measurement and control switch is turned on. Also, it is to receive an OFF signal of the measurement and control switch when the liquid crystal display panel is normally displayed, so that the first measurement and control switch is turned off.

The anti-floating switch is a thin film transistor, a gate of the thin film transistor is the control terminal of the anti-floating switch, a source of the thin film transistor is the input terminal of the anti-floating switch, and a drain of the thin film transistor is the output terminal of the anti-floating switch.

The anti-floating switch is a transmission gate, a high potential control terminal of the transmission gate is the control terminal of the anti-floating switch, a high potential input terminal is the input terminal of the anti-floating switch, a high potential output terminal is the output terminal of the anti-floating switch, and a low potential control terminal of the transmission gate is electrically connected to the enable signal input point.

The plurality of measurement and control signal input points comprise: a first measurement and control signal input point, a second measurement and control signal input point, a third measurement and control signal input point, a fourth measurement and control signal input point, a fifth measurement and control signal input point, and a sixth measurement and control signal input point.

A quantity of the first demultiplexer module is four, each first demultiplexer module comprises six first measurement and control switches, control terminals of the six first measurement and control switches in the same first demultiplexer module are accessing to the first measurement and control signal input point, the second measurement and control signal input point, the third measurement and control signal input point, the fourth measurement and control signal input point, the fifth measurement and control signal input point, and the sixth measurement and control signal input point, respectively.

The array test circuit further comprises: a second demultiplexer module, a seventh measurement and control signal input point, an eighth measurement and control signal input point, a ninth measurement and control signal input point, and a tenth measurement and control signal input point, the first demultiplexer module acquiring the data signal from the second demultiplexer module.

The second demultiplexer module comprises: four second measurement and control switches, each second measurement and control switch corresponding to one first demultiplexer module. An input terminal of each second measurement and control switch is electrically connecting to the input terminal in each first measurement and control switch of the first demultiplexer module; control terminals of the four second measurement and control switches are electrically connecting to the seventh measurement and control signal input point, the eighth measurement and control signal input point, the ninth measurement and control signal input point, and the tenth measurement and control signal input point, respectively. Input terminals of the four second measurement and control switches are accessing to the data signal.

The array test circuit further comprises: a data signal input point, the data signal input point is used for providing the data signal to the second demultiplexer module.

The enabling switch is a thin film transistor, a gate of the thin film transistor is the control terminal of the enabling switch, a source of the thin film transistor is the input terminal of the enabling switch, and a drain of the thin film transistor is the output terminal of the enabling switch.

The first measurement and control switch is a thin film transistor, a gate of the thin film transistor is the control terminal of the first measurement and control switch, a source of the thin film transistor is the input terminal of the first measurement and control switch, and a drain of the thin film transistor is the output terminal of the first measurement and control switch.

The present disclosure further provides an array test circuit, comprising: at least one first demultiplexer module, an enable signal input point, a plurality of measurement and control signal input points, a plurality of data lines, a plurality of enabling switches, a plurality of anti-floating switches, and an inverter.

Each first demultiplexer module comprises: a plurality of first measurement and control switches.

Each first measurement and control switch is corresponding to one enabling switch, a control terminal of each first measurement and control switch is electrically connecting to one measurement and control signal input point, an input terminal of each first measurement and control switch is accessing to a data signal, an output terminal of each first measurement and control switch is electrically connecting to an input terminal of corresponding enabling switch.

Each enabling switch is corresponding to one data line, a control terminal of each enabling switch is electrically connecting to the enable signal input point, and an output terminal of each enabling switch is electrically connecting to one corresponding data line.

Each anti-floating switch is corresponding to one measurement and control input point. A control terminal of each anti-floating switch is electrically connecting to an output terminal of the inverter, an input terminal of each anti-floating switch is accessing to an OFF signal of the measurement and control switch, and an output terminal of each anti-floating switch is electrically connecting to one corresponding measurement and control signal input point.

The enable signal input point is used to receive a high potential enable signal when the array substrate is tested, so that the enabling switch is turned on and the anti-floating switch is turned off. Also, it is to receive a low potential enable signal when the liquid crystal display panel is normally displayed, so that the enabling switch is turned off and the anti-floating switch is turned on.

The measurement and control signal input point is used to receive a measurement and control signal when the array substrate is tested, so that the first measurement and control switch is turned on. Also, it is to receive an OFF signal of the measurement and control switch when the liquid crystal display panel is normally displayed, so that the first measurement and control switch is turned off.

Wherein the plurality of measurement and control signal input points comprise: a first measurement and control signal input point, a second measurement and control signal input point, a third measurement and control signal input point, a fourth measurement and control signal input point, a fifth measurement and control signal input point, and a sixth measurement and control signal input point.

Wherein a quantity of the first demultiplexer module is four, each first demultiplexer module comprises six first measurement and control switches. Control terminals of the six first measurement and control switches in the same first demultiplexer module are accessing to the first measurement and control signal input point, the second measurement and control signal input point, the third measurement and control signal input point, the fourth measurement and control signal input point, the fifth measurement and control signal input point, and the sixth measurement and control signal input point, respectively.

Wherein the array test circuit further comprises a second demultiplexer module, a seventh measurement and control signal input point, an eighth measurement and control signal input point, a ninth measurement and control signal input point, and a tenth measurement and control signal input point, the first demultiplexer module acquiring data signals from the second demultiplexer module:

Wherein the second demultiplexer module comprises: four second measurement and control switches. Each second measurement and control switch is corresponding to one first demultiplexer module. An input terminal of each second measurement and control switch is electrically connecting to the input terminal in each first measurement and control switch of the first demultiplexer module; control terminals of the four second measurement and control switches is electrically connecting to the seventh measurement and control signal input point, the eighth measurement and control signal input point, the ninth measurement and control signal input point, and the tenth measurement and control signal input point, respectively. Input terminals of the four second measurement and control switches are accessing to the data signals.

Wherein the array test circuit further comprises a data signal input point, the data signal input point is used for providing the data signal to the second demultiplexer module.

Wherein the enabling switch is a thin film transistor, a gate of the thin film transistor is the control terminal of the enabling switch, a source of the thin film transistor is the input terminal of the enabling switch, and a drain of the thin film transistor is the output terminal of the enabling switch.

The advantages of the present disclosure are: the present disclosure provides an array test circuit, comprising: at least one first demultiplexer module, an enable signal input point, a plurality of measurement and control signal input points, a plurality of data lines, a plurality of enabling switches, a plurality of anti-floating switches, and an inverter.

A control terminal of each first measurement and control switch is electrically connecting to one measurement and control signal input point, an input terminal of each first measurement and control switch is accessing to a data signal, an output terminal of each first measurement and control switch is electrically connecting to an input terminal of corresponding enabling switch.

A control terminal of each enabling switch is electrically connecting to the enable signal input point, and an output terminal of each enabling switch is electrically connecting to one corresponding data line.

A control terminal of each anti-floating switch is electrically connecting to an output terminal of the inverter, an input terminal of each anti-floating switch is accessing to an OFF signal of the measurement and control switch, an output terminal of each anti-floating switch is electrically connecting to one corresponding measurement and control signal input point.

By turning on the anti-floating switch and inputting the OFF signal of the measurement and control switch to the measurement and control signal input point when the liquid crystal display panel is displayed, the switches in the demultiplexer can be kept in the OFF state when the liquid crystal display panel is normally display, so as to avoid the switch in the demultiplexer being kept in a floating state, to enhance the stability of the liquid crystal display panel.

BRIEF DESCRIPTION OF THE DRAWINGS

For a better understanding of the aforementioned content of the present disclosure, preferable embodiments are illustrated in accordance with the attached figures as follows. Apparently, the attached figures of the following description are only some embodiments of the present disclosure, to the person having ordinary skill in the art, it is able to derive other figures according to these attached figures without precondition to make creative effort. In the drawings.

DETAILED DESCRIPTION OF PREFERRED EMBODIMENTS

For further describe the technical function and effect of the present disclosure, the following descriptions of the respective embodiments are specific embodiments capable of being implemented as illustrations of the present disclosure.

Figure 1:
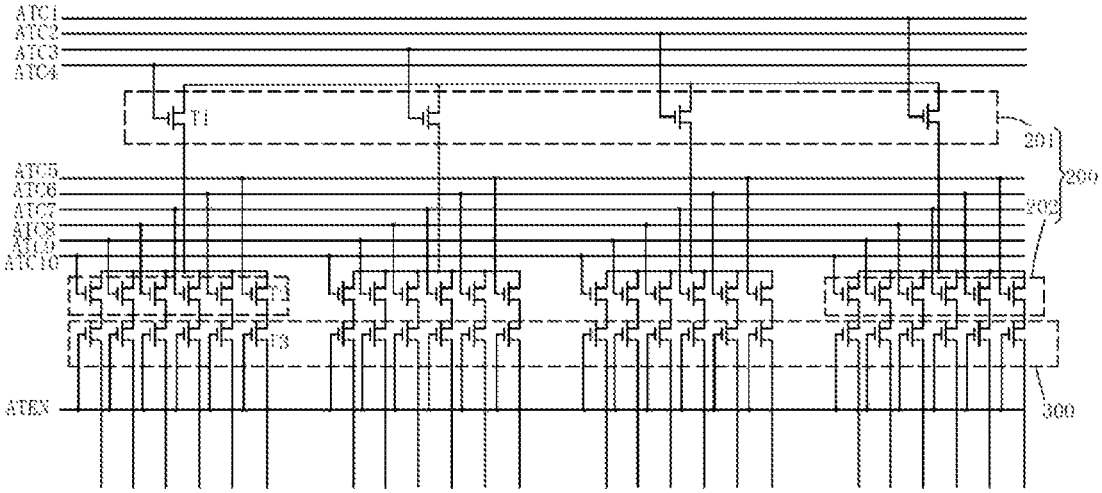
FIG. 1 is a circuit diagram of an existing array test circuit.
Figure 2:
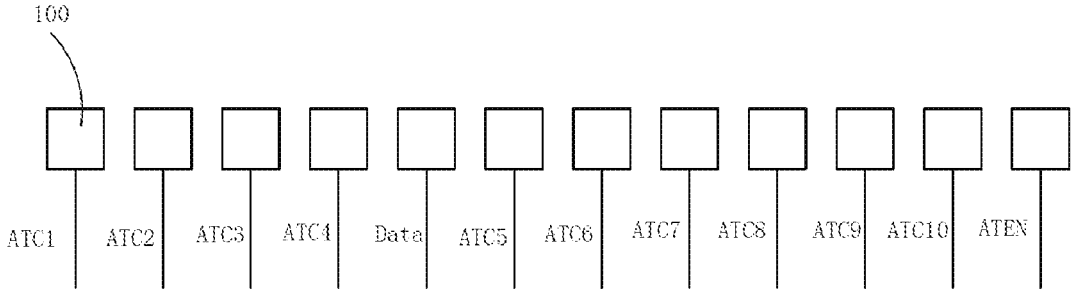
FIG. 2 is a schematic diagram of array test points of an existing array test circuit.
Figure 3:
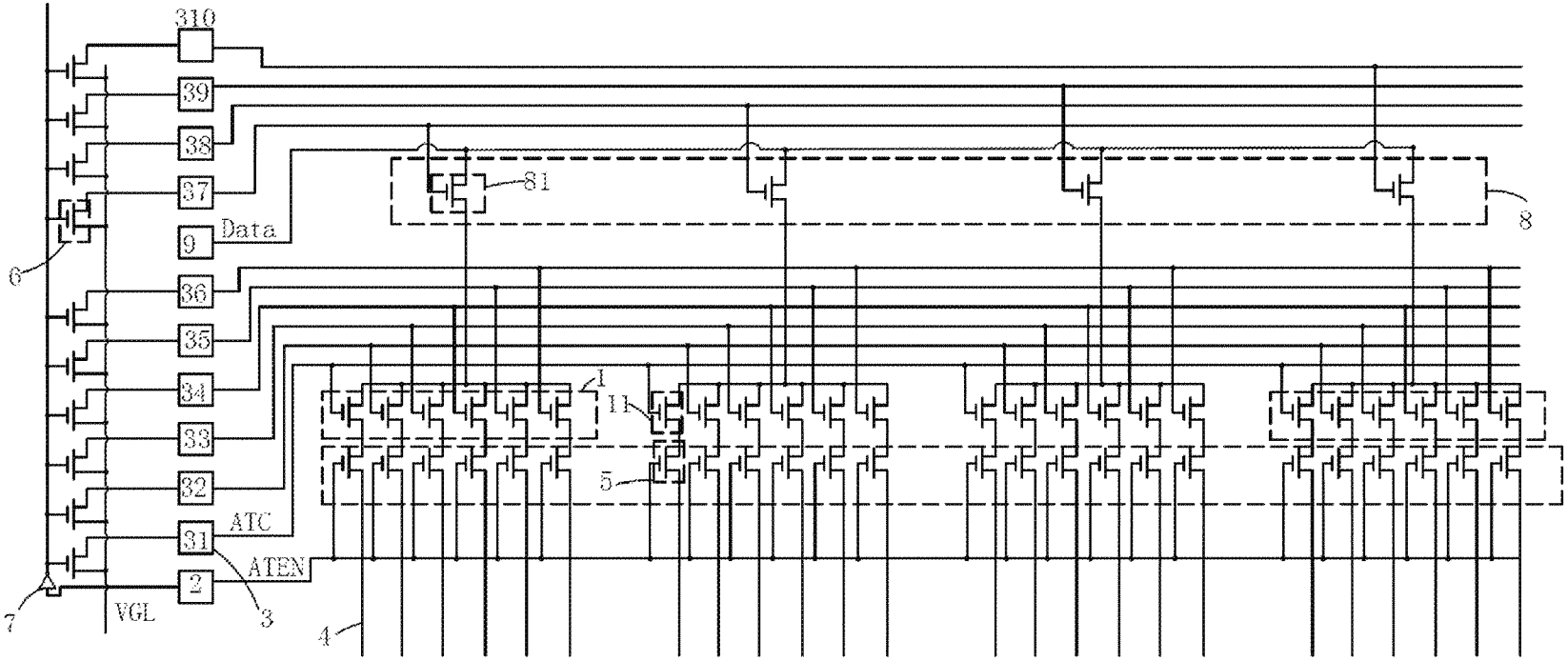
FIG. 3 is a circuit diagram of an array test circuit according to a first embodiment of the present disclosure.

Please refer to FIG. 3, the present disclosure provides an array test circuit comprising: at least one first demultiplexer module 1, an enable signal input point 2, a plurality of measurement and control signal input points 3, a plurality of data lines 4, a plurality of enabling switches 5, a plurality of anti-floating switches 6, and an inverter 7.

Each first measurement and control switch 11 is corresponding to one enabling switch 5, a control terminal of each first measurement and control switch 11 is electrically connecting to one measurement and control signal input point 3, an input terminal of each first measurement and control switch is accessing to a data signal, and an output terminal of each first measurement and control switch is electrically connecting to an input terminal of corresponding enabling switch 5.

Each enabling switch 5 is corresponding to one data line 4, a control terminal of each enabling switch 5 is electrically connecting to the enable signal input point 2, and an output terminal of each enabling switch is electrically connecting to one corresponding data line 4.

Each anti-floating switch 6 is corresponding to one measurement and control input point 3, a control terminal of each anti-floating switch 6 is electrically connecting to an output terminal of the inverter 7, an input terminal of each anti-floating switch is accessing to an OFF signal (VGL) of the measurement and control switch, an output terminal of each anti-floating switch is electrically connecting to one corresponding measurement and control signal input point 3.

The enable signal input point 2 is used to receive a high potential enable signal (ATEN) when the array substrate is tested, so that the enabling switch 5 is turned on and the anti-floating switch 6 is turned off. Also, it is to receive a low potential enable signal (ATEN) when the liquid crystal display panel is normally displayed, so that the enabling switch 5 is turned off and the anti-floating switch is turned on.

The measurement and control signal input point 3 is used to receive a measurement and control signal (ATC) when the array substrate is tested, so that the first measurement and control switch 11 is turned on. Also, it is to receive an OFF signal (VGL) of the measurement and control switch when the liquid crystal display panel is normally displayed, so that the first measurement and control switch 11 is turned off.

Specifically, as shown in FIG. 3, in a first embodiment of the present disclosure, the anti-floating switch 6 is a thin film transistor, a gate of the thin film transistor is the control terminal of the anti-floating switch 6, a source of the thin film transistor is the input terminal of the anti-floating switch 6, and a drain of the thin film transistor is the output terminal of the anti-floating switch 6.

Figure 4:
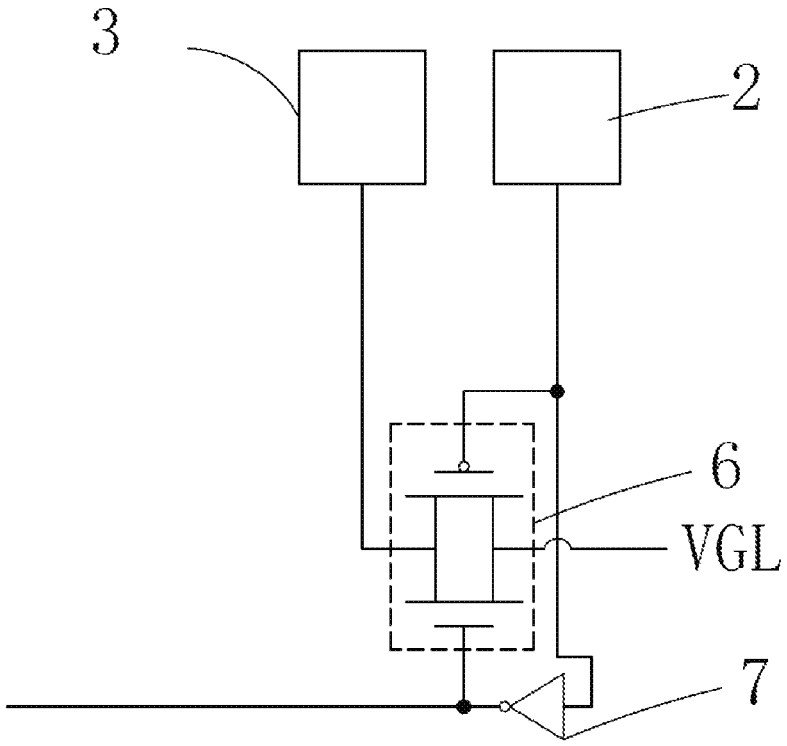
FIG. 4 is a partial enlarged view of an anti-floating switch elements of the array test circuit according to a second embodiment of the present disclosure.

Specifically, as shown in FIG. 4, in a second embodiment of the present disclosure, the anti-floating switch 6 is a transmission gate, a high potential control terminal of the transmission gate is the control terminal of the anti-floating switch 6, a high potential input terminal is the input terminal of the anti-floating switch 6, a high potential output terminal is the output terminal of the anti-floating switch 6, and a low potential control terminal of the transmission gate is electrically connected to the enable signal input point 2.

Preferably, the potential of the low potential enable signal (ATEN) is −7V, and the potential OFF signal (VGL) of the measurement and control switch is −7V.

In particularly, as shown in FIG. 3, the plurality of measurement and control signal input points 3 may be selected to include: a first measurement and control signal input point 31, a second measurement and control signal input point 32, a third measurement and control signal input point 33, a fourth measurement and control signal input point 34, a fifth measurement and control signal input point 35, and a sixth measurement and control signal input point 36.

The number of the first demultiplexer modules 1 is four, and each of the first demultiplexer modules 1 includes six first measurement and control switches 11. The control terminals of the six control and control switches 11 in the same first demultiplexer modules 1 are accessing to the first measurement and control signal input point 31, the second measurement signal input point 32, the third measurement signal input point 33, the fourth measurement signal input point 34, the fifth measurement signal input point 35, and the sixth measurement and control signal input point 36, respectively.

In particularly, as shown in FIG. 3, the array test circuit further comprises: a second demultiplexer module 8, a seventh measurement and control signal input point 37, an eighth measurement and control signal input point 38, a ninth measurement and control signal input point 39, and a tenth measurement and control signal input point 310. The first demultiplexer module 1 acquiring the data signal from the second demultiplexer module 8.

The second demultiplexer module 8 comprises: four second measurement and control switches 81. Each second measurement and control switch 81 is corresponding to one first demultiplexer module 1, an input terminal of each second measurement and control switch 81 is electrically connecting to the input terminal in each first measurement and control switch 11 of the first demultiplexer module 1; control terminals of the four second measurement and control switches 81 are electrically connecting to the seventh measurement and control signal input point 37, the eighth measurement and control signal input point 38, the ninth measurement and control signal input point 39, and the tenth measurement and control signal input point 310, respectively. Input terminals of the four second measurement and control switches 81 are accessing to the data signal.

Specifically, in the foregoing embodiment, the array test circuit further comprises: a data signal input point 9, the data signal input point 9 is used for providing the data signal to the second demultiplexer module 8.

Preferably, the enabling switch 5 is a thin film transistor, a gate of the thin film transistor is the control terminal of the enabling switch 5, a source of the thin film transistor is the input terminal of the enabling switch 5, and a drain of the thin film transistor is the output terminal of the enabling switch 5. The first measurement and control switch 11 is a thin film transistor, a gate of the thin film transistor is the control terminal of the first measurement and control switch 11, a source of the thin film transistor is the input terminal of the first measurement and control switch 11, and a drain of the thin film transistor is the output terminal of the first measurement and control switch 11.

It should be noted that the operation of the array test circuit of the present disclosure comprises: performing an array substrate test, and each of the measurement and control signal input points 3 receiving different measurement and control signals (ATC), respectively, so that the first measurement and control switch 11 and the second measurement and control switch 81 are turned on. The data signal is output from the demultiplexer module, the enable signal input point 2 receives the high potential enable signal (ATEN), the enabling switch 5 is turned on, and the data signal is written into data line 4 and subjected to the array substrate test. Meanwhile, the high potential enable signal (ATEN) inverted to a low potential signal, the anti-floating switch 6 is turned off, the OFF signal (VGL) of the measurement and control switch cannot be written to the measurement and control signal input point 3, such that preventing the impact of the array test.

After the test to the array test is complete, the liquid crystal display panel is normally displayed, each measurement and control signal input point 3 no longer receives the measurement and control signal (ATC), the enable signal input point 2 receives the low potential enable signal (ATEN), the enable enabling switch 5 are all turned off. Meanwhile the low potential enable signal (ATEN) is inverted to a high potential signal, the anti-floating switch 6 is turned on, and the OFF signal (VGL) of the measurement and control switch is written into the measurement and control signal input point 3, so that the first measurement and control switch 11 and the second measurement and control switch 81 are both turned off.

Compared with the conventional liquid crystal display panel that the switches of the demultiplexer are in the floating state, the array test circuit of the present disclosure ensure the switches of the demultiplexer being kept in an OFF state when the liquid crystal display panel is normally displayed. So as to enhance the stability of the liquid crystal display panel.

In summary, the present disclosure provides an array test circuit comprising: at least one first demultiplexer module, an enable signal input point, a plurality of measurement and control signal input points, a plurality of data lines, a plurality of enabling switches, a plurality of anti-floating switches, and an inverter.

A control terminal of each first measurement and control switch is electrically connecting to one measurement and control signal input point, an input terminal of each first measurement and control switch is accessing to a data signal, an output terminal of each first measurement and control switch is electrically connecting to an input terminal of corresponding enabling switch.

A control terminal of each enabling switch is electrically connecting to the enable signal input point, and an output terminal of each enabling switch is electrically connecting to one corresponding data line.

A control terminal of each anti-floating switch is electrically connecting to an output terminal of the inverter, an input terminal of each anti-floating switch is accessing to an OFF signal of the measurement and control switch, an output terminal of each anti-floating switch is electrically connecting to one corresponding measurement and control signal input point.

By turning on the anti-floating switch and inputting the OFF signal of the measurement and control switch to the measurement and control signal input point when the liquid crystal display panel is displayed, the switches in the demultiplexer can be kept in the OFF state when the liquid crystal display panel is normally display, so as to avoid the switches in the demultiplexer being kept in a floating state, to enhance the stability of the liquid crystal display panel.

It should be noted that the above embodiments are merely illustrative of the technical solutions of the present disclosure and are not intended to be limiting thereof. For the person skilled in the art of the disclosure, without departing from the concept of the disclosure, simple deductions or substitutions can be made and should be included in the protection scope of the disclosure.

What is claimed is:

1. An array test circuit comprising: at least one first demultiplexer module, an enable signal input point, a plurality of measurement and control signal input points, a plurality of data lines, a plurality of enabling switches, a plurality of anti-floating switches, and an inverter;

each first demultiplexer module comprising: a plurality of first measurement and control switches;

each first measurement and control switch corresponding to one enabling switch, a control terminal of each first measurement and control switch electrically connecting to one measurement and control signal input point, an input terminal of each first measurement and control switch accessing to a data signal, an output terminal of each first measurement and control switch electrically connecting to an input terminal of the corresponding enabling switch;

each enabling switch corresponding to one data line, a control terminal of each enabling switch electrically connecting to the enable signal input point, and an output terminal of each enabling switch electrically connecting to one corresponding data line;

each anti-floating switch corresponding to one measurement and control input point, a control terminal of each anti-floating switch electrically connecting to an output terminal of the inverter, an input terminal of each anti-floating switch accessing to an OFF signal of the measurement and control switch, an output terminal of each anti-floating switch electrically connecting to one corresponding measurement and control signal input point;

the enable signal input point being used to receive a high potential enable signal when the array substrate is tested, so that the enabling switch is turned on and the anti-floating switch is turned off, and to receive a low potential enable signal when the liquid crystal display panel is normally displayed, so that the enabling switch is turned off and the anti-floating switch is turned on;

the measurement and control signal input point being used to receive a measurement and control signal when the array substrate is tested, so that the first measurement and control switch is turned on, and to receive an OFF signal of the measurement and control switch when the liquid crystal display panel is normally displayed, so that the first measurement and control switch is turned off.

2. The array test circuit according to claim 1, wherein the anti-floating switch is a thin film transistor, a gate of the thin film transistor is the control terminal of the anti-floating switch, a source of the thin film transistor is the input terminal of the anti-floating switch, and a drain of the thin film transistor is the output terminal of the anti-floating switch.

3. The array test circuit according to claim 1, wherein the anti-floating switch is a transmission gate, a high potential control terminal of the transmission gate is the control terminal of the anti-floating switch, a high potential input terminal is the input terminal of the anti-floating switch, a high potential output terminal is the output terminal of the anti-floating switch, and a low potential control terminal of the transmission gate is electrically connected to the enable signal input point.

4. The array test circuit according to claim 1, wherein the plurality of measurement and control signal input points comprise: a first measurement and control signal input point, a second measurement and control signal input point, a third measurement and control signal input point, a fourth measurement and control signal input point, a fifth measurement and control signal input point, and a sixth measurement and control signal input point;

the quantity of the first demultiplexer module is four, each first demultiplexer module comprises six first measurement and control switches, control terminals of the six first measurement and control switches in the same first demultiplexer module are accessing to the first measurement and control signal input point, the second measurement and control signal input point, the third measurement and control signal input point, the fourth measurement and control signal input point, the fifth measurement and control signal input point, and the sixth measurement and control signal input point, respectively.

5. The array test circuit according to claim 4, further comprising: a second demultiplexer module, a seventh measurement and control signal input point, an eighth measurement and control signal input point, a ninth measurement and control signal input point, and a tenth measurement and control signal input point, the first demultiplexer module acquiring the data signal from the second demultiplexer module;

the second demultiplexer module comprising: four second measurement and control switches, each second measurement and control switch corresponding to one first demultiplexer module, an input terminal of each second measurement and control switch electrically connecting to the input terminal in each first measurement and control switch of the first demultiplexer module; control terminals of the four second measurement and control switches electrically connecting to the seventh measurement and control signal input point, the eighth measurement and control signal input point, the ninth measurement and control signal input point, and the tenth measurement and control signal input point, respectively; and input terminals of the four second measurement and control switches accessing to the data signal.

6. The array test circuit according to claim 5, further comprising: a data signal input point, the data signal input point being used for providing the data signal to the second demultiplexer module.

7. The array test circuit according to claim 1, wherein the enabling switch is a thin film transistor, a gate of the thin film transistor is the control terminal of the enabling switch, a source of the thin film transistor is the input terminal of the enabling switch, and a drain of the thin film transistor is the output terminal of the enabling switch.

8. The array test circuit according to claim 1, wherein the first measurement and control switch is a thin film transistor, a gate of the thin film transistor is the control terminal of the first measurement and control switch, a source of the thin film transistor is the input terminal of the first measurement and control switch, and a drain of the thin film transistor is the output terminal of the first measurement and control switch.

9. An array test circuit comprising: at least one first demultiplexer module, an enable signal input point, a plurality of measurement and control signal input points, a plurality of data lines, a plurality of enabling switches, a plurality of anti-floating switches, and an inverter;

each first demultiplexer module comprising: a plurality of first measurement and control switches;

each first measurement and control switch corresponding to one enabling switch, a control terminal of each first measurement and control switch electrically connecting to one measurement and control signal input point, an input terminal of each first measurement and control switch accessing to a data signal, an output terminal of each first measurement and control switch electrically connecting to an input terminal of the corresponding enabling switch;

each enabling switch corresponding to one data line, a control terminal of each enabling switch electrically connecting to the enable signal input point, and an output terminal of each enabling switch electrically connecting to one corresponding data line;

each anti-floating switch corresponding to one measurement and control input point, a control terminal of each anti-floating switch electrically connecting to an output terminal of the inverter, an input terminal of each anti-floating switch accessing to an OFF signal of the measurement and control switch, an output terminal of each anti-floating switch electrically connecting to one corresponding measurement and control signal input point;

the enable signal input point being used to receive a high potential enable signal when the array substrate is tested, so that the enabling switch is turned on and the anti-floating switch is turned off, and to receive a low potential enable signal when the liquid crystal display panel is normally displayed, so that the enabling switch is turned off and the anti-floating switch is turned on;

the measurement and control signal input point being used to receive a measurement and control signal when the array substrate is tested, so that the first measurement and control switch is turned on, and to receive an OFF signal of the measurement and control switch when the liquid crystal display panel is normally displayed, so that the first measurement and control switch is turned off;

wherein the plurality of measurement and control signal input points comprise: a first measurement and control signal input point, a second measurement and control signal input point, a third measurement and control signal input point, a fourth measurement and control signal input point, a fifth measurement and control signal input point, and a sixth measurement and control signal input point;

wherein a quantity of the first demultiplexer module is four, each first demultiplexer module comprises six first measurement and control switches, control terminals of the six first measurement and control switches in the same first demultiplexer module are accessing to the first measurement and control signal input point, the second measurement and control signal input point, the third measurement and control signal input point, the fourth measurement and control signal input point, the fifth measurement and control signal input point, and the sixth measurement and control signal input point, respectively;

wherein the array test circuit further comprises a second demultiplexer module, a seventh measurement and control signal input point, an eighth measurement and control signal input point, a ninth measurement and control signal input point, and a tenth measurement and control signal input point, the first demultiplexer module acquiring data signals from the second demultiplexer module;

wherein the second demultiplexer module comprising: four second measurement and control switches, each second measurement and control switch corresponding to one first demultiplexer module, an input terminal of each second measurement and control switch electrically connecting to the input terminal in each first measurement and control switch of the first demultiplexer module; control terminals of the four second measurement and control switches electrically connecting to the seventh measurement and control signal input point, the eighth measurement and control signal input point, the ninth measurement and control signal input point, and the tenth measurement and control signal input point, respectively, input terminals of the four second measurement and control switches accessing to the data signals;

wherein the array test circuit further comprises a data signal input point, the data signal input point being used for providing the data signal to the second demultiplexer module;

wherein the enabling switch is a thin film transistor, a gate of the thin film transistor is the control terminal of the enabling switch, a source of the thin film transistor is the input terminal of the enabling switch, and a drain of the thin film transistor is the output terminal of the enabling switch.

10. The array test circuit according to claim 9, wherein the anti-floating switch is a thin film transistor, a gate of the thin film transistor is the control terminal of the anti-floating switch, a source of the thin film transistor is the input terminal of the anti-floating switch, and a drain of the thin film transistor is the output terminal of the anti-floating switch.

11. The array test circuit according to claim 9, wherein the anti-floating switch is a transmission gate, a high potential control terminal of the transmission gate is the control terminal of the anti-floating switch, a high potential input terminal is the input terminal of the anti-floating switch, a high potential output terminal is the output terminal of the anti-floating switch, and a low potential control terminal of the transmission gate is electrically connected to the enable signal input point.

12. The array test circuit according to claim 9, wherein the first measurement and control switch is a thin film transistor, a gate of the thin film transistor is the control terminal of the first measurement and control switch, a source of the thin film transistor is the input terminal of the first measurement and control switch, and a drain of the thin film transistor is the output terminal of the first measurement and control switch.

* * * * *